US012291251B2

(12) United States Patent
Dunn et al.

(10) Patent No.: US 12,291,251 B2
(45) Date of Patent: May 6, 2025

(54) RAIL AUTHORITY SYSTEM AND/OR METHOD

(71) Applicant: Parallel Systems, Inc., Los Angeles, CA (US)

(72) Inventors: Patrick Dunn, Los Angeles, CA (US); Benjamin Stuart Stabler, Los Angeles, CA (US); Marc Greenbaum, Los Angeles, CA (US); Babatunde Ogunfemi, Los Angeles, CA (US)

(73) Assignee: Parallel Systems, Inc., Los Angeles, CA (US)

( * ) Notice: Subject to any disclaimer, the term of this patent is extended or adjusted under 35 U.S.C. 154(b) by 0 days.

(21) Appl. No.: 18/666,128

(22) Filed: May 16, 2024

(65) Prior Publication Data

US 2024/0300556 A1 Sep. 12, 2024

Related U.S. Application Data

(63) Continuation of application No. 18/373,225, filed on Sep. 26, 2023, now Pat. No. 12,017,692.

(60) Provisional application No. 63/423,355, filed on Nov. 7, 2022, provisional application No. 63/410,031, filed on Sep. 26, 2022.

(51) Int. Cl.

| | |
|---|---|
| ***B61L 27/16*** | (2022.01) |
| ***B61L 27/00*** | (2022.01) |
| ***B61L 27/12*** | (2022.01) |
| ***B61L 27/18*** | (2022.01) |

(52) U.S. Cl.

CPC ..... *B61L 27/16* (2022.01); *B61L 27/12* (2022.01); *B61L 27/18* (2022.01)

(58) Field of Classification Search

None

See application file for complete search history.

(56) References Cited

U.S. PATENT DOCUMENTS

| | | | | |
|---|---|---|---|---|
| 3,848,533 | A | 11/1974 | Grow | |
| 11,305,796 | B1 * | 4/2022 | Shue | B61L 27/70 |
| 2004/0006413 | A1 * | 1/2004 | Kane | B61L 15/0054 701/19 |
| 2009/0184211 | A1 * | 7/2009 | Groves, Jr. | B61L 27/33 246/3 |

(Continued)

FOREIGN PATENT DOCUMENTS

| | | | |
|---|---|---|---|
| CA | 3074977 | A1 | 10/2020 |
| JP | 6851278 | B2 | 3/2021 |

(Continued)

OTHER PUBLICATIONS

Dunn, Patrick , et al., "Rail Authority System and/or Method", U.S. Appl. No. 18/373,225, filed Sep. 26, 2023.

(Continued)

*Primary Examiner* — Adam D Tissot

(74) *Attorney, Agent, or Firm* — Jeffrey Schox; Diana Lin

(57) ABSTRACT

The system 100 can include: a railroad integration system, a motion planner, a vehicle controller, an optional user interface (UI), an optional fleet management system, and an optional track data system. However, the system 100 can additionally or alternatively include any other suitable set of components. The system functions to facilitate vehicle control and/or manage authority within a rail network.

20 Claims, 7 Drawing Sheets

(56) References Cited

U.S. PATENT DOCUMENTS

| | | | | |
|---|---|---|---|---|
| 2012/0203419 | A1 | 8/2012 | Tucker et al. | |
| 2016/0368495 | A1 | 12/2016 | Luther et al. | |
| 2016/0375888 | A1 | 12/2016 | Allwardt | |
| 2017/0108876 | A1 | 4/2017 | Mullan et al. | |
| 2017/0320507 | A1* | 11/2017 | Denny | E01F 9/30 |
| 2018/0079436 | A1 | 3/2018 | Fifield | |
| 2018/0231972 | A1 | 8/2018 | Woon et al. | |
| 2018/0339719 | A1 | 11/2018 | Loughlin | |
| 2019/0054929 | A1 | 2/2019 | Yao et al. | |
| 2019/0176862 | A1 | 6/2019 | Kumar et al. | |
| 2019/0281052 | A1 | 9/2019 | Lekkas | |
| 2019/0389498 | A1 | 12/2019 | Grimm et al. | |
| 2021/0094567 | A1 | 4/2021 | Imai et al. | |
| 2021/0094597 | A1 | 4/2021 | Rush et al. | |
| 2021/0132625 | A1 | 5/2021 | Gillett | |
| 2021/0188332 | A1 | 6/2021 | Brooks et al. | |
| 2021/0291883 | A1 | 9/2021 | Gotlund et al. | |
| 2022/0137623 | A1 | 5/2022 | Goyal et al. | |
| 2022/0185350 | A1* | 6/2022 | Kindt | B61L 1/18 |

FOREIGN PATENT DOCUMENTS

| | | | |
|---|---|---|---|
| WO | 2017211593 | A1 | 12/2017 |
| WO | 2018026615 | A1 | 2/2018 |
| WO | 2018054616 | A1 | 3/2018 |
| WO | 2022192795 | A2 | 9/2022 |

OTHER PUBLICATIONS

Dunn, Patrick , et al., "Rail Control System and/or Method", U.S. Appl. No. 18/499,034, filed Oct. 31, 2023.

Dunn, Patrick , et al., "System and/or Method for Remote Operation of a Rail Vehicle", U.S. Appl. No. 18/514,946, filed Nov. 20, 2023.

Fraga-Lamas, Paula , et al., "Towards the Internet of Smart Trains: A Review on Industrial IoT Connected Railways", Sensors, Jun. 21, 2017, URL: https://www.mdpi.com/1424-8220/17/6/1457.

Greenbaum, Marc , et al., "Railway Switch Management System and/or Method", U.S. Appl. No. 18/672,864, filed May 23, 2024.

Pendleton, Scott Drew, et al., "Perception, Planning, Control, and Coordination for Autonomous Vehicles", Google Scholar, M DPI Machines, Feb. 2017, pp. 1-54. (Year: 2017).

Sanaei , et al., "Interface for a Railway Control System", Chalmers University of Technology, Dec. 13, 2011, <URL: http://odr.chalmers.se/bitstreams/fcb1915c-254a-4c15-b364 66d99a4c2167/download>.

Singh, Prashant , "Deployment of Autonomous Trains in Rail Transportation: Current Trends and Existing Challenges", Google Scholar , IEEE Access, vol. 9, Jun. 2021, pp. 91427-91461. (Year: 2021).

Dunn, Patrick , et al., "Remote Rail Monitoring System and/or Method", U.S. Appl. No. 18/776,069, filed Jul. 17, 2024.

* cited by examiner

RAIL AUTHORITY SYSTEM AND/OR METHOD

CROSS REFERENCE TO RELATED APPLICATIONS

This application is a continuation of U.S. application Ser. No. 18/373,225, filed 26 Sep. 2023, which claims the benefit of U.S. Provisional Application Ser. No. 63/423,355, filed 7 Nov. 2022, and U.S. Provisional Application Ser. No. 63/410,031, filed 26 Sep. 2022, each of which is incorporated herein in its entirety by this reference.

TECHNICAL FIELD

This invention relates generally to the transportation field, and more specifically to a new and useful rail authority system and/or method in the transportation field.

BACKGROUND

Metro trains utilize block authority systems to prevent train collisions, where track authority is subdivided into 'blocks' of rail which only one train may occupy at a time. Conventional implementations of railroad block authority typically limit the number of trains and/or the speed at which trains can operate along a line, as they are closely related to the overall route capacity and are generally tied to the physical equipment (e.g., signals) along the route. Moving block systems can improve route capacity, since they are not tied to fixed blocks or signal arrangements, but often require additional infrastructure along the track and/or to all trains within the network (e.g., trains may use magnetic inductance to inject signals into the line indicating their location). Since existing systems are typically designed to mitigate collision avoidance over large distances, neither conventional block authority systems nor moving block authority systems are well suited to yard operations or Positive Train Control (PTC) along a main line(s), and both are tied to specific infrastructure requirements throughout the network. Thus, there is a need in the transportation field for a new and useful rail authority system and/or method of operation.

DESCRIPTION OF THE PREFERRED EMBODIMENTS

Figure 1:
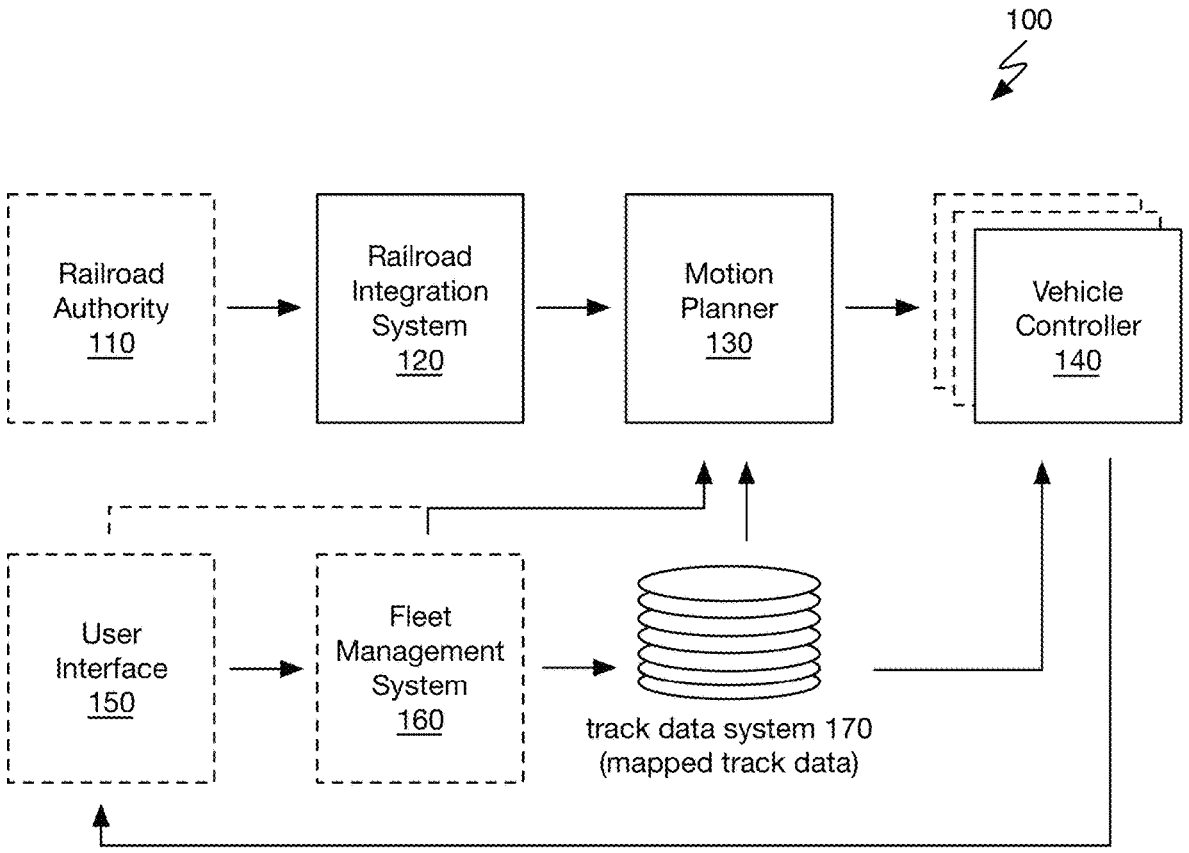
FIG. 1 is a schematic representation of a variant of the system.

The following description of the preferred embodiments of the invention is not intended to limit the invention to these preferred embodiments, but rather to enable any person skilled in the art to make and use this invention.

1. Overview.

The system 100 can include: a railroad integration system 120, a motion planner 130, a vehicle controller 140, an optional user interface (UI) 150, an optional fleet management system 160, and an optional track data system 170. However, the system 100 can additionally or alternatively include any other suitable set of components. The system functions to facilitate vehicle control and/or manage authority within a rail network.

In variants, the system can function to facilitate vehicle control of an autonomous rail vehicle(s) as described in U.S. application Ser. No. 17/335,732, filed 1 Jun. 2021, and U.S. application Ser. No. 17/694,499, filed 14 Mar. 2022, each of which is incorporated herein in its entirety by this reference.

In variants, the system can function to facilitate individual vehicle traversal and/or coordinated vehicle traversal (a.k.a., platooning) as described in U.S. application Ser. No. 17/732,143, filed 28 Apr. 2022, which is incorporated herein in its entirety by this reference. In a specific example, the system can provide warrants (e.g., "micro-warrants") to autonomous vehicles operating within a rail network.

The term "substantially" as utilized herein can mean: exactly, approximately, within a predetermined threshold or tolerance, and/or have any other suitable meaning.

1.1 Illustrative Examples.

Figure 7:
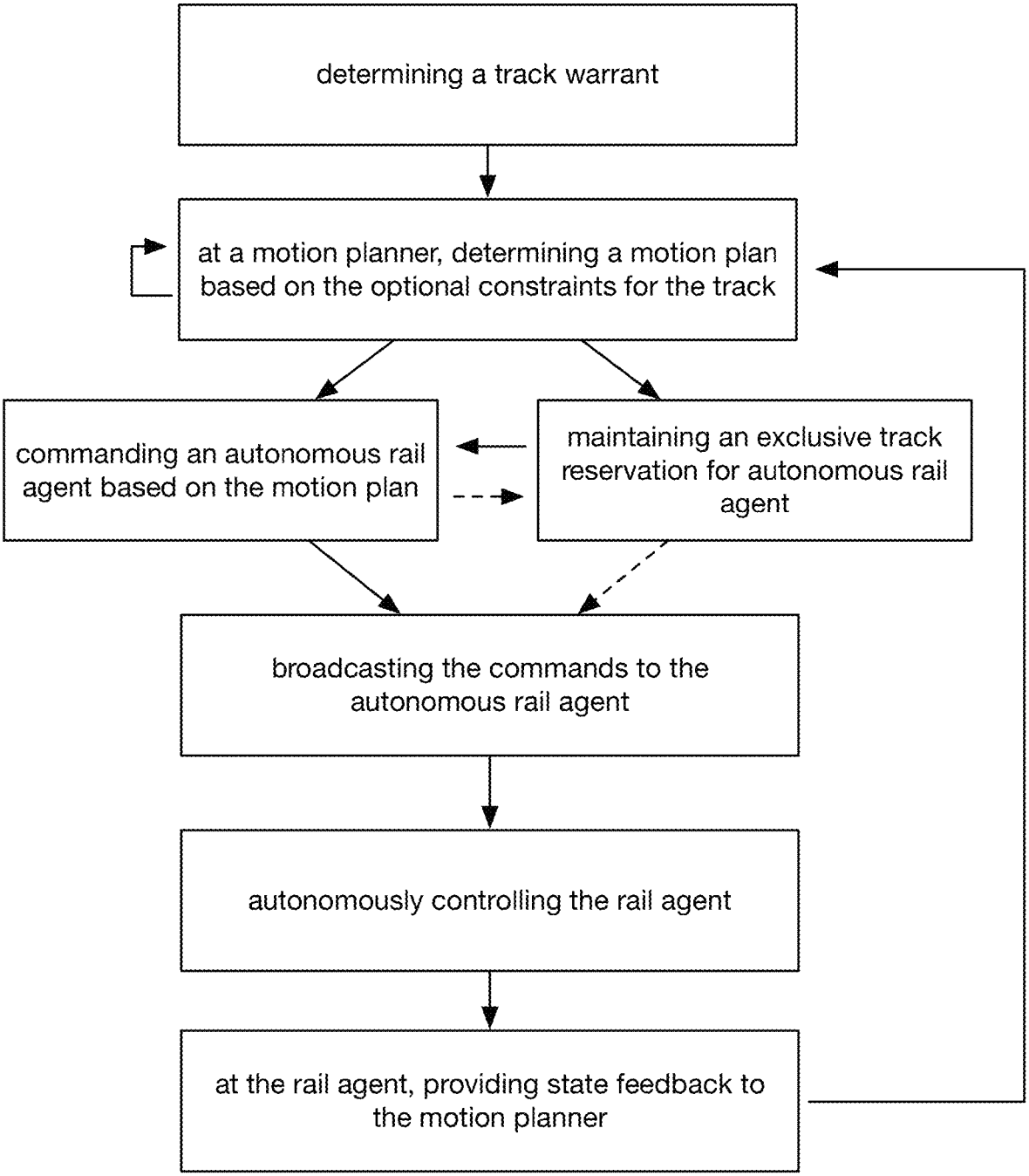
FIG. 7 is a flowchart diagrammatic example of a method variant.

In a first variant (e.g., an example is shown in FIG. 7), a positive train control (PTC) method for a set of autonomous rail agents can include: at a centralized motion planner: determining a track warrant for at least one railroad authority; based on the track warrant, determining the motion plan based on operational constraints for the track; and commanding an autonomous rail agent based on the motion plan and a state of the autonomous rail agent by periodically broadcasting commands to the autonomous rail agent; and dynamically maintaining an exclusive track reservation for the autonomous rail agent based on the commands; and at a vehicle controller of the autonomous rail agent: autonomously controlling the autonomous rail agent, within the exclusive track reservation, based on the commands and a heartbeat parameter; and providing the state of the autonomous rail agent to the centralized motion planner; wherein the exclusive track reservations are dynamically sized based on the commands and the heartbeat parameter. In variants, exclusive track reservations can be dynamically sized based further on a predetermined set of rules associated with a prior map of weak signal connectivity. In an example, the exclusive track reservations are dynamically sized to span the entirety of a tunnel.

2. Benefits.

Variations of the technology can afford several benefits and/or advantages.

Figure 2A:
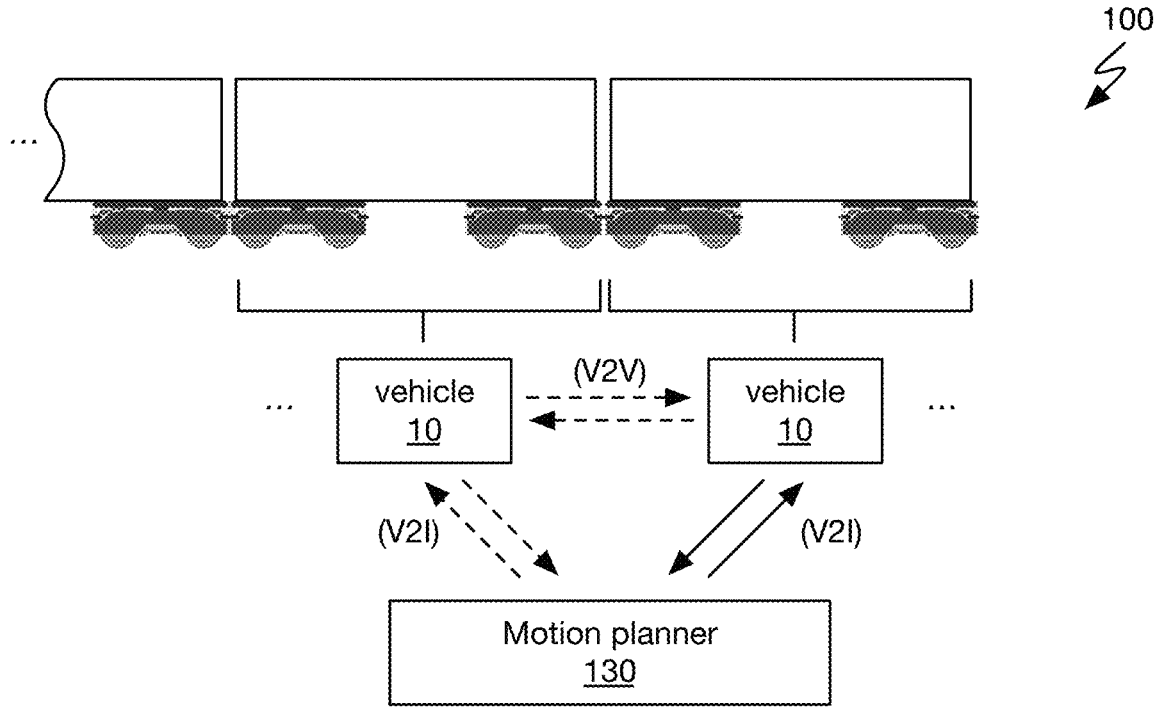
FIG. 2A is a diagrammatic representation of a variant of the system.
Figure 2B:
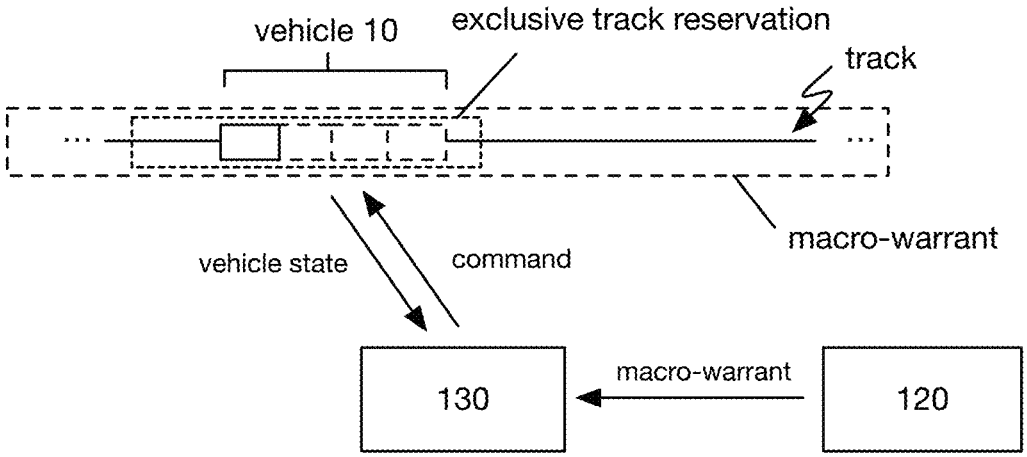
FIG. 2B is a diagrammatic representation of a variant of the system.

First, variations of this technology can maintain persistent (granular) awareness and/or control of dispatched vehicles within a rail network (e.g., in the event of communication failure, in the event of vehicle and/or dispatching failure, blackout, etc.). In variants (e.g., an example is shown in FIGS. 2A-2B), vehicles can be dispatched to operate autonomously within subregions/subsections (a.k.a., 'micro-warrants') of a railroad authority-granted region of track (a.k.a., 'macro-warrant'). In variants, the technology can facilitate asynchronous state management to facilitate error and exception handling at each endpoint (e.g., the vehicle controller and/or the remote administrative systems, such as fleet management and motion planning/dispatch).

Figure 3:
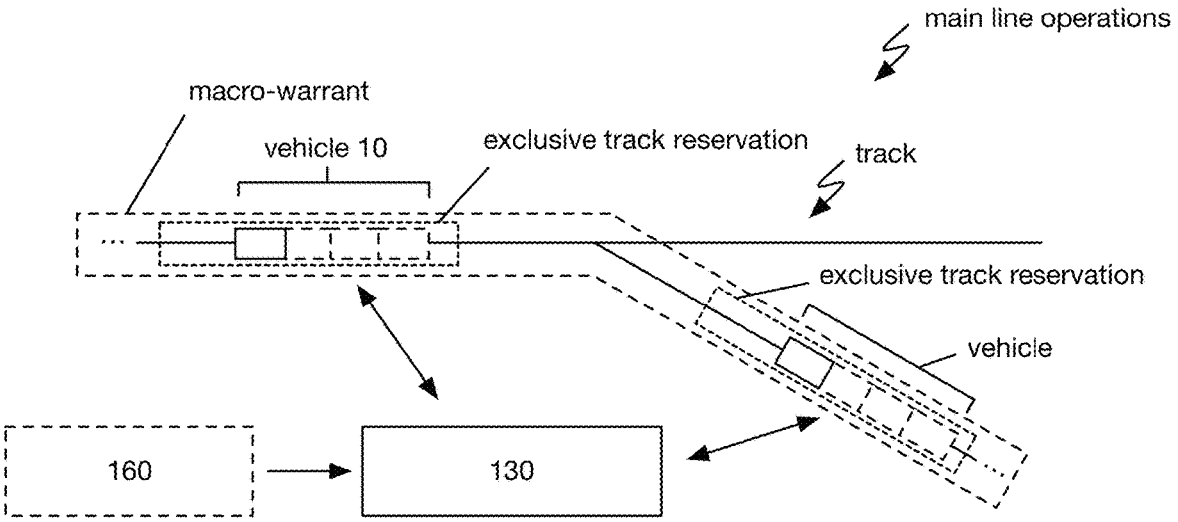
FIG. 3 is a diagrammatic representation of a variant of the system.

Second, variations of this technology can facilitate separate control of a plurality of vehicles within a single authority region (or 'macro-warrant') along a section of track, such as by providing authority to vehicles in dynamically-sized sub-regions of track (i.e., track reservations or 'micro-warrants'). Such variants can additionally facilitate rail vehicle platoon formation, traversal, and/or separation along a track (e.g., an example is shown in FIG. 3).

Figure 4:
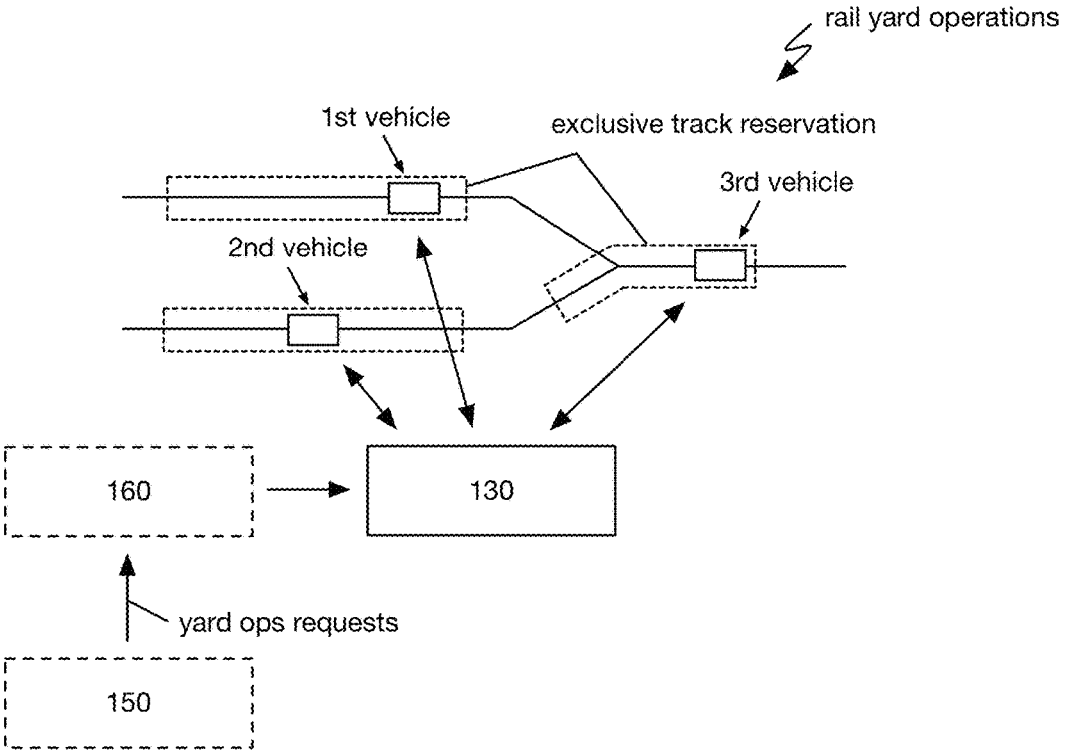
FIG. 4 is a diagrammatic representation of a variant of the system.

Third, variations of this technology can reduce and/or mitigate potential for vehicle collisions within a rail yard during separate and/or contemporaneous control of a plurality of rail vehicles within the rail yard (e.g., an example is shown in FIG. 4). For example, constraining currently issued reservations to be non-intersecting can avoid collisions between vehicles assigned to separate warrants (e.g., while vehicles operate simultaneously and/or with independent agency within respective warrants). In variants, the 'micro-warrants' can be assigned on a per car (or per bogie) basis, which may increase the number of simultaneous/contemporaneous movements occurring in a rail yard (i.e., network efficiency).

Fourth, variations of this technology can facilitate control of (autonomous) rail vehicles under a variety of railroad authority-granting schemes or authority protocols by providing an integration layer which transforms specific authority/assignment protocols into a generalized form (e.g., macro-warrant). Variants may operate with existing rail infrastructure and/or in coordination with existing train services along a railroad (e.g., without strict V2V requirements for every train operating along the same line, as may be required for some moving block authority systems).

Fifth, variations of this technology can reduce a risk of accidental collisions between autonomous vehicles in a rail network (e.g., while facilitating controlled, low-impulse collisions/contacts, such as when forming platoons of rail vehicles).

However, variations of the technology can additionally or alternately provide any other suitable benefits and/or advantages.

3. System.

Figure 5:
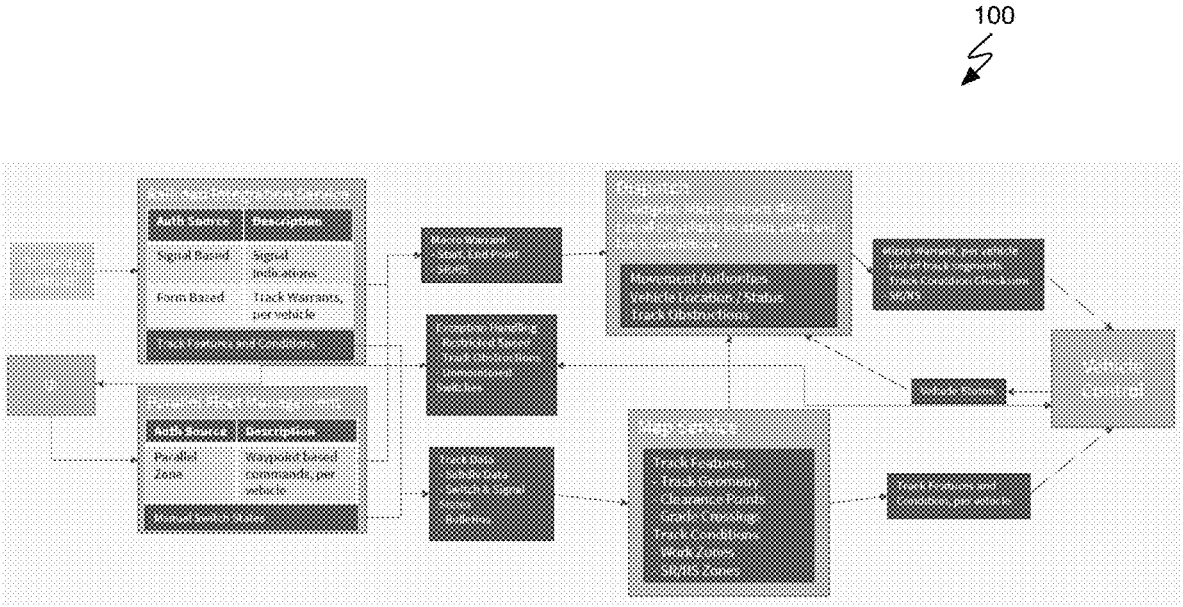
FIG. 5 is a schematic representation of a variant of the system.

The system 100, an example of which is shown in FIG. 1, can include: a railroad integration system 120, a motion planner 130, a vehicle controller 140, an optional user interface (UI) 150, an optional fleet management system 160, and an optional track data system. However, the system 100 can additionally or alternatively include any other suitable set of components. The system functions to facilitate vehicle control and/or manage authority within a rail network. An example of the system 100 is shown in FIG. 5.

3.1 Rail Authority Service

The system can optionally include or operate in conjunction with a railroad authority service 110. The railroad authority service can issue authority grants for various sections of track within a rail network. For example, a railroad authority service can grant a train service (or rail vehicle thereof) permission to operate on a section of track (e.g., 10 mile section, 50 mile section, main line track region, etc.). The rail authority system can utilize any suitable railroad authority schemes, such as manual assignment, automated assignment, and/or signaling systems.

In a specific example, an operator or a railroad authority service may grant authority in the form of digitized paper receipts and/or manual entries by a human communicating over a radiofrequency network.

In variants, a railroad authority service authority grants can include and/or can be issued in conjunction with various operational constraints, such as speed constraints, directional constraints (e.g., forward only, bidirectional, etc.), time constraints, restricted speed requirements, and/or any other suitable operational constraints.

However, the system can operate in conjunction with any other suitable railroad authority and/or altogether exclude a railroad authority system (e.g., in a yard operations context, etc.). Additionally, the system can operate in conjunction with a plurality of railroad authorities (e.g., each with various authority granting schemes) and/or can be agnostic to the authority granting scheme.

3.2 Railroad Integration

The railroad integration system 120 functions to translate authority grants from the railroad authority(ies) into a macro-warrant which can be provided to the motion planner (a.k.a., vehicle dispatch system). Additionally or alternatively, the railroad integration system can transform protocol-specific authority grants, issued by a railroad authority, into a unified/generalized form (e.g., macro-warrant). Additionally or alternatively, the railroad integration system can be used to update mapped track data based on information received from the railroad authority (e.g., map updates, track condition updates, track feature updates, etc.).

The railroad integration system can receive a set of inputs from the railroad authority, which can include: track signals, authorization forms, track feature updates, track condition updates, and/or any other suitable information. The set of inputs is preferably received according to a predetermined protocol, specific to a particular railroad authority, but can be received in any suitable data format. In a specific example, the railroad integration service can include an API (specific to a particular railroad authority; generalized API which can interface with each railroad authority; etc.). In an example the API functions as an interface between external systems and internal systems. Examples of external systems can include: railroad authorities, railroad integration service, user devices, fleet management, and/or other systems. Examples of internal systems can include: the motion planner, track data system, map service, and/or other systems. However, the system components can be otherwise classified. Additionally or alternatively, the railroad integration service can be integrated into an API Gateway, can communicate with an API Gateway (e.g., allowing the railroad integration system and/or railroad authority to communicate with the motion planner and/or track data system), and/or can be otherwise integrated with and/or interface with various components of the system.

The railroad integration system can determine a macro-warrant, or a (coarse) authority region of track, based on the inputs. For example, the macro-warrant can be defined based on a starting and ending point along the track (e.g., coordinate point, in track map coordinates; relative to track nodes/features/segments, etc.) and can include a set of intervening track sections (e.g., relative to a track map). The inputs can be transformed into macro-warrants based on a predetermined set of rules, transformations, and/or protocols (e.g., which can be railroad authority specific or railroad authority agnostic). Macro-warrants can be determined as a one-to-one mapping of authority grants from a railroad into a track map reference frame, and/or can be further constrained based on a set of rules/heuristics. For example, macro-warrants may be used to segment 'autonomous' sections of track and 'teleoperation' sections of track (e.g., speed restricted sections, where the authority is only granted under may only under a condition of remote supervision).

In variants, macro-warrants can additionally include a set of operating constraints which can be received from the railroad authority and/or another endpoint (e.g., user interface, fleet management system), and/or can be retrieved from a track data system. For example, the operating constraints can include a speed-constraints (e.g., speed limit), directional constraint (e.g., unidirectional movement constraint, bidirectional movement constraint, etc.), track restrictions (e.g., teleoperation track segments, advisory bulletin restrictions, etc.), time constraints (e.g., expiration parameter associated with the macro-warrant, etc.), and/or any other suitable operational constraints.

In a first example, the railroad integration system can receive a digital form from the railroad authority which grants authority between a first switch and a second switch along a main line within a rail network governed by the railroad authority, and the railroad integration system can transform the digital form into a macro-warrant which can be used by the motion planner to control a set of vehicles within the rail network.

The railroad integration system can include processing and/or processing modules which can be: local, remote (e.g., at a remote server, at a third party server, cloud processing, etc.), centralized, distributed, and/or processing for the railroad integration system can be otherwise executed.

In variants, macro-warrants can be updated by the railroad integration system periodically, aperiodically, in response to receipt of an updated authority grant from a railroad authority, and/or with any other suitable timing/frequency. Additionally or alternatively, macro-warrants can be invariant/fixed until completed and/or vacated.

In variants, macro-warrants can be pushed to the motion planner, such as in response to macro-warrant issuance, and/or pulled from the motion planner (e.g., to facilitate motion planning, etc.).

However, macro-warrants can be otherwise provided to the motion planner; and/or the system can include any other suitable railroad integration system and/or otherwise interface with railroad authority granting schemes/protocols.

3.3 Motion Planner

The motion planner 130 (a.k.a., 'vehicle dispatch system') functions to direct traversal and/or dispatch a set of vehicles within the rail network. Additionally or alternatively, the motion planner can function to impose vehicle collision constraints and/or (macro-)warrant constraints on vehicles within the rail network (e.g., on a railroad governed by the railroad authority, at a rail yard, etc.). Additionally or alternatively, motion planner functions to determine a set of exclusive reservations (a.k.a., 'micro-warrants' or 'track grants') which can be used to (granularly) direct vehicle operation throughout the rail network. Additionally or alternatively, the motion planner can function to maintain state awareness of vehicles throughout the rail network (e.g., based on the exclusive track reservations).

The motion planner preferably receives the macro-warrant from the railroad integration service and/or otherwise determines a warrant(s) available for vehicle reservation/dispatch within a rail network. For example, the motion planner can receive a set of (macro-) warrants from multiple railroad authorities to facilitate dispatch of vehicles across multiple railroads and/or rail yards within the network.

Based on the macro-warrant(s), the motion planner can determine and/or issue track reservation(s) for each of the set of vehicles and/or vehicle controllers thereof operating within the rail network, thereby granting the vehicle(s) proceed authority within the track reservation(s). For example, the motion planner can dispatch vehicles by providing the track reservation to the vehicle and/or a command associated therewith, which directs operation of the vehicle within the track reservation. Track reservations are preferably exclusive, with only a single vehicle assignment available for each reservation (e.g., which may provide a collision constraint, where the trains are positively controlled to remain within an exclusive track reservation). Additionally or alternatively, multiple vehicles coordinated within a platoon may operate independently within a singular reservation, and/or track reservations can be otherwise determined/assigned. For instance, wherein each vehicle of a platoon remains in continuous compressive contact, the platoon may be treated as a singular 'train' for the purpose of dispatch and/or routing. In a first example, the motion planner can determine a respective reservation for each train (and/or platoon) within the rail network. In a second example, the motion planner can determine a respective track reservation for a single vehicle within the rail network, such as a single electric vehicle/bogie as described in U.S. application Ser. No. 17/694,499, filed 14 Mar. 2022, and/or U.S. application Ser. No. 17/335,732, filed 1 Jun. 2021, each of which is incorporated herein in its entirety by this reference.

Figure 6:
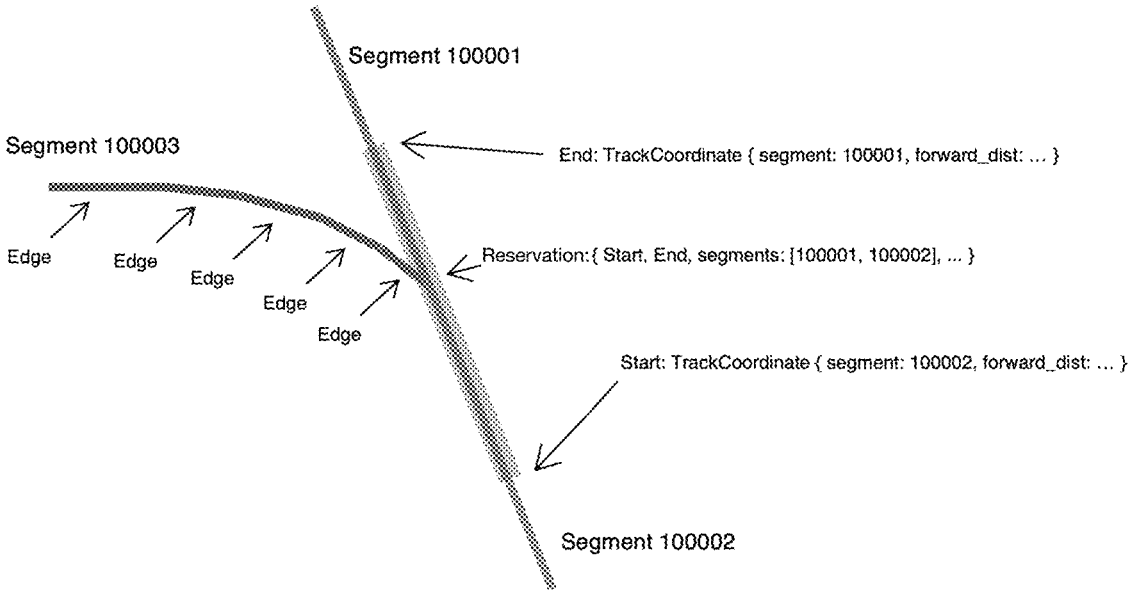
FIG. 6 is a diagrammatic example of a track reservation relative to a portion of a track map in a variant of the system.

Track reservations preferably include a (granular) region of track, which can be a subset of the macro-warrant granting movement authority (e.g., 'micro-warrant'), a list of track segments referenced to map, track boundary constraints, and/or can be otherwise defined. Additionally or alternatively, track reservations can be otherwise defined in terms of Earth-frame coordinates (e.g., GPS coordinates), track coordinates (e.g., of a track map; an example is illustrated in FIG. 6), indexed track segments, and/or otherwise defined. Additionally or alternatively, track reservations can include or be associated with a set of operational parameters (e.g., target speed, speed limit, traversal direction; track rules; operational parameters of a command associated with the track region; etc.), a track condition parameter (e.g., checksum, validation parameter, etc.), and/or any other suitable parameters/information.

Figure 8:
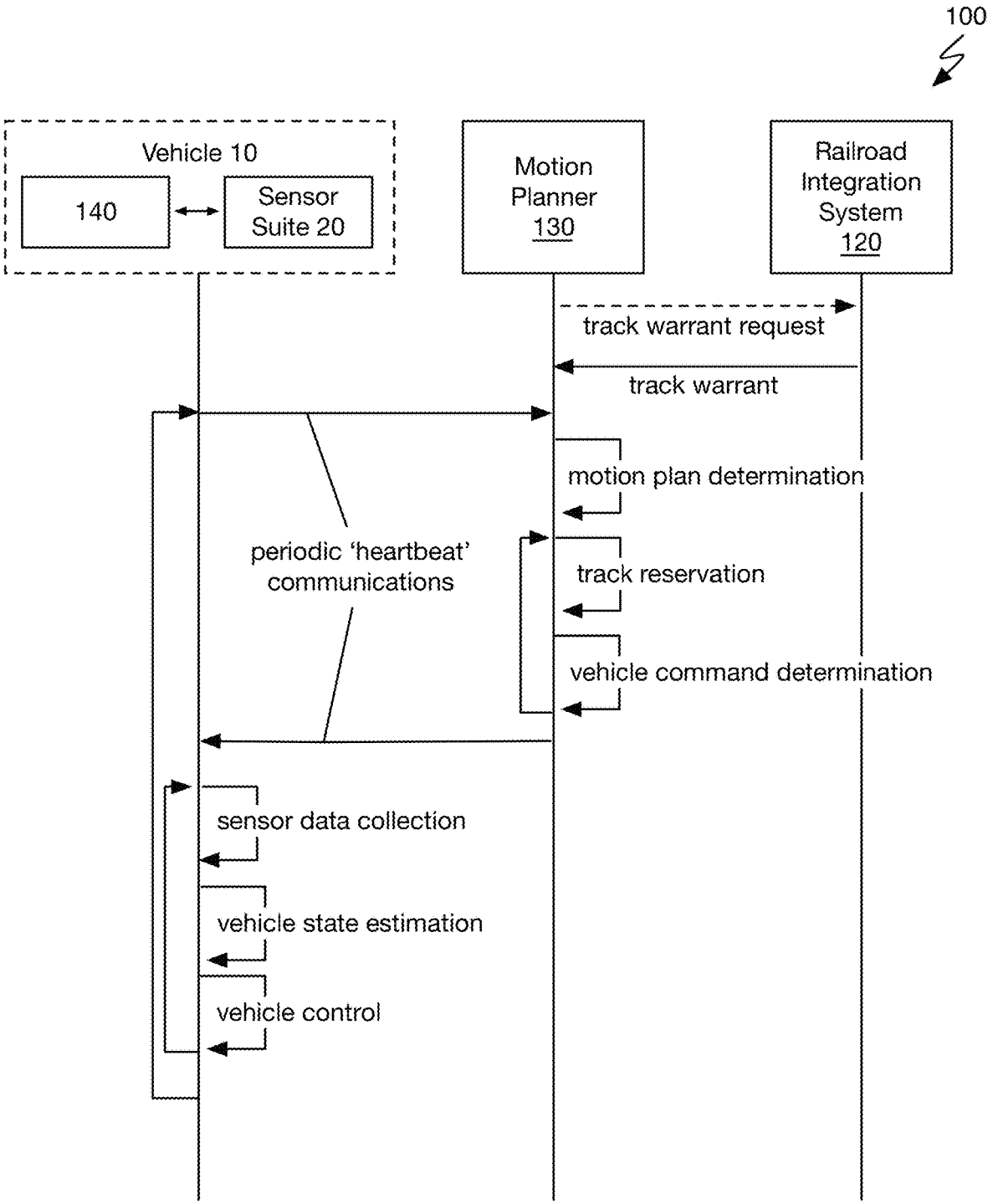
FIG. 8 is a schematic representation of a variant of the system illustrating process flow in a variant of the method.

In some variants, the track reservations can include or be associated with a heartbeat parameter (or heartbeat mechanism/signal) and/or a command expiration parameter (e.g., a duration over which proceed authority is granted according to the command). For example, the reservation and/or command issuance itself may serve as a heartbeat mechanism (e.g., an example is shown in FIG. 8), where the vehicle and/or a vehicle controller thereof is limited in its ability to autonomously/independently proceed by the (granular) authority grant of the reservation/micro-warrant. For instance, in the event of a communication failure and/or divergence in a track condition checksum for a track reservation (e.g., n+1 reservation issued to a particular vehicle), the vehicle may be limited to by the constraints of a prior (e.g., n) track reservation. In absence of communication between the motion planner and the vehicle controller, the motion planner may rely on the prior (e.g., n) track reservation and/or constraints thereof to maintain granular awareness of the location of the vehicle (e.g., which may facilitate persistent collision avoidance throughout the rail network and/or granular state estimation for the purpose to fleet management and vehicle command generation). Alternatively, the track reservations can include or be used in conjunction with a separate heartbeat parameter, which may be issued with the same timing/frequency as the track reservations or a different timing/frequency.

The motion planner can assign/issue track reservations and/or provide track reservations (a.k.a. 'micro-warrants' or 'track grants') and associated commands to vehicles (e.g., via wireless communication/broadcast, such as an LTE connection): periodically, aperiodically, in response to a command update (or change in a motion plan), in response to a track map update (e.g., change in track condition, issued bulletin, track geometry change, state change, etc.), in response to a track warrant update (e.g., based on and/or with any other suitable timing/frequency), in response to receipt of an updated vehicle state (e.g., from the vehicle controller), in conjunction with (and/or as an element of) a command or command signal, and/or with any other suitable timing/frequency. More preferably, the motion planner can issue reservations with at least a (predetermined) minimum frequency (e.g., corresponding to a heartbeat parameter/signal). For example, commands and/or track reservation(s) associated therewith can function as a heartbeat signal and can be issued periodically (e.g., every 10 seconds, every 20 seconds, etc.). Additionally or alternatively, commands may correspond directly to an authority grant to (and/or assignment of) a track reservation.

The track reservations can include or correspond to a (granular) region of track and/or operational parameters of vehicle commands which direct vehicle routing and/or traversal within the rail network.

In one set of variants, the motion planner can determine vehicle commands based on a route (or 'motion plan') for the vehicle between an initial position (e.g., current/initial track coordinate; initial waypoint) and a destination (e.g., end track coordinate or waypoint) along a sequence of track segments. For instance, a motion plan may route a vehicle across junctions/switches (e.g., which may not be presently lined and/or which may be currently reserved), reserved regions of track (e.g., for which track reservations exist; which the vehicle may not presently occupy), and/or otherwise extends beyond the current constraints on the vehicle operation and/or current track reservation for the vehicle. As an example, the motion planner may determine a motion plan along an extant (macro-)warrant and repeatedly determine/issue commands to direct granular traversal of the vehicle based on the current constraints of the track (e.g., current reservations and local track rules, etc.). The commands and/or the track reservation therewith may govern proceed authority in accordance with the motion plan.

In a first example, a vehicle command can direct a vehicle in a particular direction between a starting and ending location (e.g., the distance between the starting location and ending location can be 50 miles in the case of main line operations or a 10 meter sequence of track spanning a gate or switch in the case of yard operations, etc.). In a second example, a vehicle command can direct a vehicle to traverse a particular distance down the track (e.g., corresponding to the reservation and heartbeat mechanism). In a third example, a vehicle command can be a navigational route (e.g., referenced/indexed against the track map). In a fourth example, vehicle commands can be waypoint-based commands. Vehicle commands can be predetermined (e.g., for a train running a fixed schedule), received from a fleet management system, manually determined by a human operator (e.g., commanding vehicle operation within a rail yard; determined and/or selected via the user interface), and/or otherwise determined. Commands can be assigned/directed to a particular vehicle and/or a vehicle identifier associated with a vehicle controller of the vehicle. For example, a command can be associated with a navigation and traversal of a train between an initial track coordinate and an end track coordinate. Alternatively, vehicle commands can be unassigned, undirected, vehicle indiscriminate, and/or can be any other suitable commands.

In variants, the motion planner can automatically determine and/or update track reservations based on: extant macro-warrant(s) (e.g., received from the railroad integration system), existing track reservations (e.g., where track reservations may not overlap by rule), the vehicle commands (e.g., received from a fleet management system), the vehicle state (e.g., received from the vehicle controller to which the reservation will be granted/assigned), track conditions (e.g., received/retrieved track map data), the track reservation update frequency, other vehicles' states, platoon parameters (e.g., number of vehicles in a platoon, platoon weight, etc.), and/or any other suitable information. In a first example, the track region of a track reservation can be automatically determined contemporaneously and/or synchronously with (autonomous) operation/control of the respective vehicle (e.g., by the vehicle controller) to facilitate continuous and/or unencumbered operation of the respective vehicle under nominal conditions (e.g., absent emergent scenarios, absent proximal changes to track conditions, etc.). For instance, the motion planner can sequentially determine track reservations spanning adjacent portions of track which collectively grant the vehicle authority to maintain a substantially continuous speed (e.g., 30 mph; based on the vehicle command) while traversing a track region which exceeds the bounds of an initial reservation of the sequence. At the motion planner, the track reservations can be: calculated, looked up, determined using a set of heuristics, predicted (e.g., using a trained neural network), predetermined, randomly determined, manually determined, and/or otherwise determined by the motion planner. The track reservations generated from the same macro-warrant can have the same or different parameters (e.g., track region, duration, velocity permissions, etc.).

In some variants, the track region of a reservation can be dynamically determined (e.g., reservations can be dynamically sized in time and/or space), such as based on the operational constraints of a command (e.g., a target speed and expiration parameter) and/or vehicle state (e.g., vehicle speed, maximum stopping distance under current conditions, etc.). In a first nonexclusive example, the size of the track region can be dynamically determined based on a target speed parameter (e.g., target vehicle speed, where the track region spans traversal of the current location of the vehicle and a traversal distance associated with vehicle traversal at target vehicle speed over a period of time, such as a warrant update cycle duration). In a second nonexclusive example, the track reservations can be dynamically sized based on a track geometry constraint(s) (e.g., where the warrant may terminate prior to a gate or switch, such as in cases where a rail switch state may not be verified/validated and/or where the switch is misaligned). In a third nonexclusive example, the track reservation(s) can be dynamically sized based on a user input and/or user command (e.g., where the vehicle may only be traversing a short section of track, etc.). In a fourth nonexclusive example, the track reservation(s) can be dynamically sized based on a geometry of a proximal reservation (e.g., where the reservations may not overlap, where the sets of track segments associated with each extant reservation are disjoint, where the reservations may be offset by at least a predetermined distance, which may impose collision constraints, etc.). In a fifth nonexclusive example, the track reservations can be dynamically determined based on (autonomous) vehicle performance constraints, such as a perception distance (e.g., how far ahead the vehicle is able to observe, such as based on terrain, track curvature, etc.), braking performance characteristics (e.g., minimum braking distance, etc.). In a sixth nonexclusive example, track reservations can be dynamically sized based on a known communication dead-zone (e.g., based on a map of communication dead-zones, such as may exist in rural settings, tunnels, etc.). For instance, a track reservation may be sized to span the entirety of a tunnel (e.g., where signal connectivity may be predictably absent until the vehicle traverses the tunnel).

In one variant, track reservations can be dynamically determined by: estimating a traversal distance along the track over the duration of the heartbeat (e.g., multiplying the current speed and/or maximum speed of the vehicle by the time length of a heartbeat period); determining maximum braking distance for the vehicle (e.g., from a lookup table, based on track requirements, estimated based on an estimated/target vehicle speed, etc.); and determining the track reservation as the region/track segments ahead the vehicle in a direction of traversal (e.g., along a navigation route), beginning from the current vehicle location and extending along a path length of at least the sum of the estimated traversal distance and the maximum braking distance. In a second variant, the track reservations can be determined as the track on the current location of the vehicle using a predetermined lookup table (e.g., based on vehicle speed and/or a target vehicle speed) and/or a predetermined set of rules/heuristics to determine the size/length of the track reservation ahead of the current location of the vehicle. Additionally, the region of the track reservation can be extended based on offsets in either direction, such as to accommodate: bidirectional traversal, a length of the vehicle, train, or platoon, communication latency, braking distance offsets, predetermined offsets between vehicles (e.g., offset between the track reservation and an existing track reservation associated with another vehicle), perception-based offsets, switch clearance distances, and/or any other suitable offsets which may extend the track region of the track reservation in either direction. Additionally or alternatively, the forward end of the track reservation in the direction of traversal can be truncated—which may force the vehicle to slow—in order to command the vehicle to slow/stop based on various track features and/or track conditions (e.g., hazards, track obstructions, track geometry features, clearance points, grade crossings, intersections, work zones, SR/RS zones, mapped features, etc.). For example, the region can be truncated to terminate ahead of a grade crossing or a node in the track map geometry, such as when a switch state may prevent the vehicle from proceeding along a planned route. Alternatively, the region can span one or more mapped track features/conditions (e.g., where switch states are predetermined/known, where track features/conditions are addressed locally at the vehicle controller, etc.). Additionally, the track reservation can be truncated to prevent the track reservation from intersecting/overlapping an existing track reservation assignment associated with another vehicle/platoon (e.g., which may impose a collision constraint and/or avoid collisions between vehicles/platoons).

In some variants, the motion planner can determine/grant a single track reservation within a macro-warrant or a plurality of track reservations per macro-warrant (e.g., which may facilitate platoon formation, such as described in U.S. application Ser. No. 17/732,143, filed 28 Apr. 2022, which is incorporated herein in its entirety by this reference). Track reservation grants can be maintained indefinitely (e.g., while the vehicle occupies the corresponding region of track), can expire based on an expiration condition (e.g., in response to a determination of a superseding/replacement track reservation at a subsequent time, in response to satisfaction of an expiration condition associated with an expiration parameter, in response to vehicle egress from the corresponding track region, etc.), and/or can be otherwise managed. In a first example, a track reservation can be superseded by a subsequent track reservation associated with the same vehicle (e.g., vehicle controller and/or vehicle identifier). Alternatively, track reservations can remain active/valid until a vehicle vacates the track reservation (e.g., confirms operation under a subsequent track reservation and/or communicates a release the track reservation) and/or can be otherwise released/managed.

The motion planner preferably maintains exactly one active/valid reservation (a.k.a., micro-warrant) per vehicle, but can additionally or alternatively issue two active/valid reservation per vehicle (e.g., wherein the vehicle operates under exactly one track reservation; wherein the $n^{th}$ reservation is superseded by the $n+1^{th}$ reservation in response to a subsequent heartbeat confirmation, but both remain valid in absence of the heartbeat signal to accommodate asynchronous operation of the vehicle and motion planner), a plurality of reservations per vehicle (e.g., each corresponding to a respective expiration parameter), and/or any other suitable number of track reservations per vehicle and/or vehicle controller. In one example, a track reservation can be issued to the lead vehicle at a forward end of a platoon. In a second example, a track reservation can be communicated to a plurality of vehicle controllers within a platoon (e.g., at a lead vehicle of each car, each vehicle controller, etc.; where each vehicle controller is individually constrained to operate within the track reservation). In a third example, track reservations can be issued for the collective of vehicles within a platoon, but can additionally or alternatively be issued independently for each of a plurality of vehicles within the platoon (e.g., where each vehicle is individually limited by tighter constraints on the track reservation, such as based on a relative position along the length of the platoon). However, track reservations can be otherwise suitably granted.

The motion planner can include processing and/or processing modules which can be: local, remote (e.g., at a remote server, at a third party server, cloud processing, etc.), centralized, distributed, and/or processing for the motion planner can be otherwise executed. In a specific example, motion planning/dispatch can be regional and/or a set of regional motion planners can each govern track reservation issuance over a respective track region. In variants, the motion planner and the set of vehicles (and/or vehicle controllers thereof) within the network preferably operate contemporaneously and/or synchronously, where the motion planner can issue track reservations asynchronously to individual vehicles of the set (e.g., facilitating asynchronous state management of the vehicles within the network).

The motion planner preferably manages track reservations within a unified database/repository (e.g., maintaining redundancy and/or concurrency) and/or other data storage system. In a complete loss of power and/or communications at the motion planner (e.g., total power outage), the existing reservations remain, thereby maintaining belief state awareness and PTC throughout the network (i.e., no new reservations are issued, PTC maintained from prior belief state). For example, the motion planner may re-establish communication with each vehicle before issuing further reservations/commands.

In variants, the motion planner may optionally grant exceptions around regions of known poor signal connectivity. For instance, loss of GPS and external wireless communications may be predictable within a tunnel, where it is also less likely that the vehicle may encounter other hazards/trains (e.g., where greater access restrictions exist; due limited environmental access; etc.). Accordingly, the motion planner may adjust heartbeat parameters (e.g., length of timeout), track reservations, and/or otherwise facilitate traversal through regions of poor signal connectivity. For example, the motion planner may adjust track reservations based on a prior map of weak signal (and/or no-signal) connectivity (e.g., where latency and/or location accuracy falls below a predetermined threshold, where GPS is unavailable, etc.), such as may be predetermined based on prior communication data and/or tunnel locations. Alternatively, signal connectivity maps can be pulled from external databases, and/or otherwise determined/derived. In variants, signal connectivity exceptions may be granted based on specific rules (e.g., enabling a vehicle to traverse a tunnel or dead-zone; separate speed constraints; etc.), and/or can be otherwise implemented. Alternatively, vehicle authority grants may be separately issued for tunnels (e.g., locally) and/or signal connectivity exceptions may be otherwise handled. Additionally or alternatively, signal connectivity exceptions may be handled locally at the vehicle(s) (e.g., where stopping requirements may be temporarily suspended within a dead zone or weak-signal region, such as may exist in rural areas).

However, the system can include any other suitable motion planner and/or vehicle dispatch system.

3.4 Vehicle

The system can include or be used in conjunction with a vehicle(s) 10 which traverse within a rail network according to the motion plan and/or commands associated therewith. The vehicles can include a sensor suite 20 and a vehicle controller 140, and/or any other suitable elements. The sensor suite functions to collect sensor data (e.g., localization, imaging, etc.), with which the vehicle controller can estimate the vehicle state and determine vehicle control (e.g., based on commands issued by a motion planner and/or proceed authority from a remote operator). However, the vehicle can include any other suitable elements and/or can be otherwise configured. Additionally or alternatively, the system and/or operator platform thereof can be configured to facilitate operation of a remote vehicle and/or can be used with any other suitable vehicle(s).

In variants, the vehicle(s) can be as described in one or more of: U.S. application Ser. No. 17/694,499, filed 14 Mar. 2022, titled "ELECTRIC RAIL VEHICLE," U.S. application Ser. No. 17/335,732, filed 1 Jun. 2021, titled "ELECTRIC RAIL VEHICLE," each of which is incorporated herein in its entirety by this reference.

In variants, the vehicle controller can facilitate vehicle control and/or platooning in accordance with the system and/or methods as described in U.S. application Ser. No. 17/732,143, filed 28 Apr. 2022, which is incorporated herein in its entirety by this reference. In a specific example, the vehicle controller can be the controller of a leading vehicle of a leading car of a platoon (e.g., wherein a remainder of vehicles and/or cars of the platoon are controlled based on the operation of the leading car).

The sensor suite functions to monitor vehicle state parameters which can be used for vehicle control (e.g., autonomous vehicle control). The sensor suite can include: internal sensors (e.g., force sensors, accelerometers, gyroscopes, IMU, INS, temperature, voltage/current sensors, etc.), external antennas (e.g., GPS, cellular, Bluetooth, Wi-Fi, Near Field Communication, etc.), rail sensors (e.g., wheel encoders, cameras, temperature sensors, voltage/current sensors, accelerometers, etc.), payload sensors (e.g., force sensors/switches, cameras, lights, accelerometers, NFC sensors, etc.), environmental sensors (e.g., cameras, temperature, wind speed/direction, accelerometers), guidance sensors (e.g., load cells, bumper contact switches, strain sensors, lights, horn, sonar, lidar, radar, cameras, etc.), and/or any other suitable sensors. The sensors can include one or more: Radar sensors, LIDAR sensors, sonar sensors, cameras, spatial sensors, location sensors, force sensors, on-board diagnostic sensors such as vehicle mechanism sensors, audio sensors, barometers, light sensors, temperature sensors, current sensors, air flow meters, voltmeters, contact sensors, proximity sensors, vibration sensors, ultrasound sensors, electrical sensors, and/or any other suitable sensors. However, the electric vehicle can include any other suitable sensors.

However, the vehicle can include any other suitable set of sensors.

Each vehicle controller functions to control a vehicle within the rail network to facilitate operation of the vehicle based on the vehicle commands. More preferably, the vehicle controller functions to facilitate autonomous operation of the vehicle within a reservation (and/or reserved region of track associated therewith), based on the constraints of the reservation and/or the operational parameters of the reservation. As an example, the vehicle controller may retain agency to stop based on perceived surroundings or internal diagnostics, but the movement/control of the vehicle controller may be limited by the (dynamic) constraints of the reservation. For example, the reservation may constrain: maximum speed, maximum proceed distance (e.g., movement boundaries), autonomy level (e.g., full autonomy, partial autonomy, human-in-the-loop control, etc.), direction of operation (e.g., unidirectional operation, bidirectional operation, etc.), period of command validity (e.g., where the vehicle must stop in absence of a currently valid command), and/or can otherwise constrain vehicle operation.

The vehicle controller preferably determines a vehicle state (a.k.a., vehicle status) and communicates the vehicle state to the motion planner (e.g., which can be used for validation, verification, and/or subsequent reservation determination). The vehicle state determined by the vehicle controller can include: speed estimation, battery characteristics (e.g., state of charge, state of health, state of power, etc.), heading, diagnostic parameters (e.g., battery characteristics, powertrain characteristics, sensor characteristics, etc.), perception performance (e.g., heading distance, etc.), brake performance estimates (e.g., max stopping distance), environmental representations (e.g., classification of objects/obstacles in the environment), and/or any other suitable vehicle state parameters/estimates. Additionally or alternatively, the vehicle controller can provide any other suitable feedback and/or data to the motion planner.

Additionally, the vehicle controller can provide loop closure communicating (to the motion planner) confirmation of updates to reservation assignment (e.g., confirming operation under an n+1 reservation), switch positions, track map updates (e.g., track condition parameter; via checksum), heartbeat parameters (e.g., central system connection parameters, warrant update parameters, etc.; loop closure for heartbeat signal), and/or any other suitable information. In variants, if either the vehicle controller or the motion planner is unable to (asynchronously) validate communications and/or coordination relative to the track, the vehicle controller can control the vehicle to stop within the reservation.

In a first example, if the vehicle controller does not receive a heartbeat signal and/or an updated command/reservation (e.g., in the case of a communication failure, for example), the vehicle controller can stop the vehicle within the reserved region of track associated with a prior command (e.g., for which the vehicle has already received proceed authority). Similarly, if the motion planner is unable to validate the communications from the vehicle controller, the motion planner can directly control the vehicle to stop (e.g., via wireless communications) and/or indirectly control the vehicle to stop (e.g., restricting the vehicle by not issuing a superseding command/reservation which may be required for the vehicle to proceed). As such, a heartbeat mechanism(s) can be implemented at the vehicle controller (e.g., directing the vehicle to stop) and/or at the motion planner (e.g., commanding the vehicle to stop and/or preventing further traversal by not issuing further track grants).

Additionally or alternatively, the vehicle controller can function to distribute power and/or communications onboard the vehicle to affect vehicle control. The vehicle controller can additionally or alternatively function to implement autonomous navigation commands, teleoperation commands (e.g., received from a remote teleoperator), autonomous vehicle control (e.g., based on the set of operational parameters), and/or any other vehicle control. The controller is preferably onboard the vehicle (e.g., mounted to a vehicle chassis, etc.), but can additionally or alternatively be remote from the vehicle (e.g., secondary controller within a tunnel, etc.). The controller can be centralized (e.g., packaged within a single module) or distributed (e.g., across multiple compute nodes, packaged within multiple compute modules, etc.). The controller can receive sensory inputs/measurements from the sensor suite, which can be used to determine a vehicle state, dynamically control the vehicle, manage the batteries, and/or control the electric powertrain. The controller can include a battery management system which functions to monitor the state of the battery. The state of the battery can include: state of charge (SoC), state of health (SoH), state of power (SoP), state of safety (SoS), temperature (e.g., of the battery or a set of cells therein, of a working fluid, a temperature distribution of battery cells, etc.), and/or any other suitable characteristics. The battery management system can also function to control the charge and/or discharge of the battery. However, the controller can include any other suitable BMS. The controller can include one or more motor controllers which function to condition power from the battery to be supplied to a motor and/or to control electrical propulsion and/or dynamic (regenerative) braking at the motor. There can be a single motor controller associated with the vehicle, one motor controller per motor, and/or any other suitable number of motor controllers. However, the controller can include any other suitable motor controllers. In variants, the controller can function to facilitate vehicle transit and/or powertrain control as described in U.S. application Ser. No. 17/335,732, filed 1 Jun. 2021, which is incorporated herein in its entirety by this reference. In variants, the controller can control a platoon of electric vehicle(s) individually or may be used to control vehicles in a pairwise manner (e.g., via V2V communications, etc.).

In variants, a vehicle controller can include: a speed controller, velocity controller, PID controller, MPC controller, nonlinear controller, feedback controller, feedforward controller, and/or can implement any other suitable control schemes or any combination/permutation thereof.

However, the system can include any other suitable vehicle controller and/or operate in conjunction with any other suitable vehicle(s) or vehicle control scheme(s). Additionally or alternatively, the vehicle and/or motion planner can otherwise facilitate positive train control (PTC) via any suitable command/control paradigm.

The vehicle and/or controller thereof can be configured to transmit vehicle data to the motion planner and/or other external systems (e.g., remote data systems), which can include sensor data (e.g., camera image frames), vehicle state data (e.g., speed or velocity, localization data, etc.), timing data (e.g., GPS clock timestamp, etc.), perception data (e.g., annotated image frames; object detection/tracking data, etc.), and/or any other suitable data. Data can be offloaded with any suitable timing/frequency (e.g., event driven, periodically, based on operational mode, based on the track rules, etc.) and/or data format(s). In one set of variants, the vehicle can emit data and/or media via a WebRTC communication framework (e.g., which can facilitate in-browser web monitoring from a remote operator platform). As an example, each data frame emitted from the vehicle can include metadata such as: a timestamp and/or hashed timestamp (e.g., hashed with a specific vehicle key; timestamp with asymmetric encryption or another form of embedded cryptographic validation), vehicle state data (e.g., GPS location; linearized track position relative to a track map; etc.). However, the vehicle can transmit any other suitable data in any other suitable data format(s).

However, the system can include any other suitable vehicle controller and/or operate in conjunction with any other suitable vehicle(s) or vehicle control scheme(s).

3.5 Fleet Management

The system can optionally include or be used with a fleet management system 160 which functions to determine vehicle commands and/or direct fleet resources (e.g., vehicles, cargo, etc.) throughout the vehicle network. Additionally or alternatively, the fleet management system can facilitate track authority requests via the railroad integration service. Additionally or alternatively, the fleet management system can determine vehicle commands based on user inputs/requests via the user interface. Additionally or alternatively, the fleet management system can function to update the track map data and/or track conditions based on vehicle state information, information received via the railroad integration service (e.g., track features, track conditions, switch state), and/or information received via the user interface (e.g., manual switch state determinations). In variants, fleet management system(s) and/or resources can be integrated with the motion planner, but alternatively can be partially or entirely separate/distributed.

In some variants, the fleet management system can determine a vehicle to dispatch for a particular vehicle command, such as a set of rules, heuristics, decision logic (e.g., a decision tree, etc.), a neural network (e.g., weighted linear regression), and/or can otherwise select a vehicle for dispatch. For example, vehicles can be selected based on availability (e.g., not loaded with cargo), proximity to a target (e.g., distance, traversal time, number of intervening vehicles, etc.), vehicle state, state of charge, state of maintenance, and/or can be otherwise selected. Additionally or alternatively, commands can be manually associated with a particular vehicle (e.g., via UI inputs; where a user directs a particular vehicle to move to a particular location via the UI, for example).

In some variants, the fleet management system can facilitate routing and/or navigational optimizations (e.g., based on the track map, extant macro-warrants, etc.) for the fleet of vehicles within the rail network, which can be provided to and/or used by the motion planner communicate for route execution (e.g., motion planning, reservation determination/assignment).

However, the system can include or be used with any other fleet management system and/or can exclude a fleet management system.

Additionally or alternatively, routes and/or vehicle assignments can be manually determined (e.g., via a user interface), predetermined, and/or vehicle fleets can be otherwise suitably managed 3.6 User Interface The system can optionally include or be used with a user interface 150 which functions to facilitate manual command of vehicles (e.g., in a yard operations context). Additionally or alternatively, the user interface can function to facilitate tele-operation (e.g., in a restricted speed context), manual updates to track map data (e.g., manual determinations of switch state for unmonitored switches, etc.), manual exception handling, and/or other manual interventions/inputs. The user interface can be communicatively connected to the fleet management system and/or motion planner to provide manual commands for vehicle dispatch. Additionally, user inputs via the user interface can be used to update the track data (e.g., based on manual bulletin inputs, manual switch state inputs, etc.).

In a specific example, in yard operation contexts, user inputs via the UI can be used to generate vehicle commands, which can be used to indirectly control the vehicle(s) by track reservation assignment at the motion planner.

However, the system can include or be used with any other suitable user interface and/or can exclude a user interface.

3.7 Track Data

The system can optionally include or be used with a track data system 170 which functions to maintain track data to be used for dispatch and vehicle control. The track data maintained within the track data system can include: track features (e.g., track geometry, clearance points, grade crossings, switch states, signal states, bulletins, etc.), track conditions (e.g., work zones, SR/RS zones, etc.), hazards, and/or any other suitable data. The motion planner and the vehicle controller can both access and/or locally store track data for use in any suitable determination/control determinations. Track map data can be pushed to the motion planner and/or vehicle controller(s) and/or pulled from the track data system (e.g., by the motion planner and/or vehicle controller) with any suitable timing/frequency. In a specific example, track data pertaining to the track reservation and/or regions proximal to the vehicle can be pushed to the vehicle controller with any suitable timing/frequency (e.g., as part of the track reservation provision). However, the system can otherwise exclude a track data system and/or can operate with any other suitable track data system and/or track map(s), and/or can otherwise maintain track data knowledge/information sharing throughout the system.

The system can optionally include or be used with an Application Program Interface (API) Gateway, by which external/user-facing system(s)/components(s) can interface with the motion planner and track data systems/services (e.g., coupling the UI and/or Railroad Service the motion planner and data systems). For example, the API Gateway can handle authorization, QoS, translation protocols, and/or any other suitable tasks/functionalities. As a second example, the railroad integration system can be integrated into the API Gateway and/or can interface with vehicle dispatch via the API Gateway. However, the system can be used with any other suitable API and/or without an API Gateway in various contexts.

The track data system can be used by the motion planner to manage reservations and/or 'constraints' on commanded vehicle motion, such as may be imposed based on the track geometry (e.g., misaligned switches; changes to track geometry), speed restrictions, monitoring requirements, no-signal areas, and/or any other suitable constraints. Additionally or alternatively, track data can be used for fleet management and vehicle routing/planning, provided to users via the user interface, and/or can be otherwise suitably utilized.

However, the system can include any other suitable components.

Alternative embodiments implement the above methods and/or processing modules in non-transitory computer-readable media, storing computer-readable instructions. The instructions can be executed by computer-executable components integrated with the computer-readable medium and/or processing system. The computer-readable medium may include any suitable computer readable media such as RAMs, ROMs, flash memory, EEPROMs, optical devices (CD or DVD), hard drives, floppy drives, non-transitory computer readable media, or any suitable device. The computer-executable component can include a computing system and/or processing system (e.g., including one or more collocated or distributed, remote or local processors) connected to the non-transitory computer-readable medium, such as CPUs, GPUs, TPUS, microprocessors, or ASICs, but the instructions can alternatively or additionally be executed by any suitable dedicated hardware device.

Embodiments of the system and/or method can include every combination and permutation of the various system components and the various method processes, wherein one or more instances of the method and/or processes described herein can be performed asynchronously (e.g., sequentially), concurrently (e.g., in parallel), or in any other suitable order by and/or using one or more instances of the systems, elements, and/or entities described herein.

As a person skilled in the art will recognize from the previous detailed description and from the figures and claims, modifications and changes can be made to the preferred embodiments of the invention without departing from the scope of this invention defined in the following claims.

We claim:

1. A positive train control (PTC) method comprising:

at a first computing system, determining a motion plan for an autonomous rail agent based on a set of track rules for a track; and based on the motion plan and a state of the autonomous rail agent, commanding the autonomous rail agent by broadcasting a first command to the autonomous rail agent; and maintaining an exclusive track reservation for the autonomous rail agent based on the first command, wherein the exclusive track reservation is dynamically sized; and at a second computing system:

autonomously controlling the autonomous rail agent, within the exclusive track reservation, based on the first command; and providing the state of the autonomous rail agent to the first computing system.

2. The PTC method of claim 1, further comprising, while autonomously controlling the autonomous rail agent within the exclusive track reservation:

based on the motion plan and an updated state of the autonomous rail agent, commanding the autonomous rail agent by broadcasting second command to the autonomous rail agent; and maintaining the exclusive track reservation for the autonomous rail agent based on both the first command and the second command.

3. The PTC method of claim 2, further comprising: in response to receipt of the second command at the second computing system, autonomously controlling the autonomous rail agent within the exclusive track reservation based on the second command.

4. The PTC method of claim 1, wherein the exclusive track reservation is dynamically sized based on the first command.

5. The PTC method of claim 4, wherein the exclusive track reservation is dynamically sized in time.

6. The PTC method of claim 4, wherein the exclusive track reservation is dynamically sized in space.

7. The PTC method of claim 1, wherein the exclusive track reservation is dynamically sized based on the set of track rules.

8. The PTC method of claim 1, wherein the exclusive track reservation is dynamically sized based on a predetermined set of rules associated with a map of signal connectivity.

9. The PTC method of claim 8, wherein the exclusive track reservation is dynamically sized to span a tunnel.

10. The PTC method of claim 1, wherein the command is periodically broadcast within a time interval associated with the first command, wherein the exclusive track reservations are dynamically sized based on the time interval.

11. The PTC method of claim 1, wherein the motion plan comprises linearized coordinates along a series of track segments, wherein the exclusive track reservation comprises a granular sub-region of track within the series of track segments.

12. The PTC method of claim 1, wherein the second computing system is configured to autonomously control the vehicle to stop within the exclusive track reservation in response to a communication failure between the first computing system and the second computing system.

13. The PTC method of claim 1, wherein the autonomous rail agent is commanded based on a heartbeat mechanism, wherein the exclusive track reservation is maintained based on a heartbeat mechanism.

14. The PTC method of claim 13, wherein the heartbeat mechanism comprises the broadcast of the first command.

15. The PTC method of claim 1, further comprising: at the first computing system, determining a track warrant for a least one railroad authority, wherein the motion plan is determined based on the track warrant.

16. A system for positive train control (PTC) along a track comprising:

a motion planner configured to:

determine a motion plan for an autonomous rail vehicle based on a set of track rules of the track;

based on the motion plan and a state of the autonomous rail vehicle, command the autonomous rail agent by periodically broadcasting commands to the autonomous rail agent; and maintain an exclusive track reservation for the autonomous rail agent based on the commands, wherein the exclusive track reservation is dynamically determined based on the commands; and a vehicle controller of the autonomous rail vehicle which is communicatively coupled to the centralized motion planner and configured to:

autonomously control the autonomous rail vehicle, within the exclusive track reservation, based on the commands; and provide the state of the autonomous rail vehicle to the centralized motion planner.

17. The system for PTC of claim 16, wherein the exclusive track reservation is dynamically sized in space.

18. The system for PTC of claim 16, wherein the exclusive track reservation is dynamically sized based on an expiration parameter.

19. The system for PTC of claim 16, wherein the exclusive track reservation is dynamically sized based on the set of track rules.

20. The system for PTC of claim 16, wherein the exclusive track reservation is dynamically determined based on track geometry constraints.

* * * * *